US008294011B2

(12) United States Patent
Toone

(10) Patent No.: US 8,294,011 B2
(45) Date of Patent: Oct. 23, 2012

(54) POSITIONAL CONSTANT STRING PITCH CONTROL SYSTEM

(76) Inventor: Richard Warren Toone, Milford, NJ (US)

( * ) Notice: Subject to any disclaimer, the term of this patent is extended or adjusted under 35 U.S.C. 154(b) by 204 days.

(21) Appl. No.: 12/803,762

(22) Filed: Jul. 6, 2010

(65) Prior Publication Data

US 2011/0011238 A1 Jan. 20, 2011

Related U.S. Application Data

(60) Provisional application No. 61/270,236, filed on Jul. 6, 2009.

(51) Int. Cl.
*G10D 1/08* (2006.01)

(52) U.S. Cl. ..... 84/313

(58) Field of Classification Search ..... 84/312 R, 84/313

See application file for complete search history.

(56) References Cited

U.S. PATENT DOCUMENTS

| | | | | |
|---|---|---|---|---|
| 3,407,696 | A | 10/1968 | Smith et al. | |
| 4,004,485 | A | 1/1977 | Hiscott | |
| 4,625,614 | A | 12/1986 | Spercel | |
| 4,878,413 | A | 11/1989 | Steinberger | |
| 5,311,804 | A | 5/1994 | Wilkinson | |
| 5,814,746 | A | 9/1998 | Stafford | |
| 6,087,570 | A | 7/2000 | Sherlock | |
| 6,150,592 | A | 11/2000 | Casper | |
| 6,184,450 | B1 | 2/2001 | LeBlanc | |
| 6,806,411 | B1 | 10/2004 | Allen | |
| 6,875,911 | B2 | 4/2005 | Schryer | |
| 7,183,475 | B2 | 2/2007 | Van Halen | |
| 7,326,839 | B2 | 2/2008 | Kinoshita | |
| 7,339,102 | B2 | 3/2008 | Folmar et al. | |
| 7,446,248 | B2 | 11/2008 | Skinn et al. | |
| 7,521,616 | B2 | 4/2009 | Kahler | |
| 7,692,079 | B2 | 4/2010 | Lyles | |
| 7,960,630 | B2 * | 6/2011 | Steinberger | 84/313 |

* cited by examiner

*Primary Examiner* — Kimberly Lockett

(57) ABSTRACT

A method and apparatus to hold a string of a stringed instrument and allow for precise tuning of the string as chosen by the user.

17 Claims, 5 Drawing Sheets

FIG. 7

POSITIONAL CONSTANT STRING PITCH CONTROL SYSTEM

CROSS REFERENCE TO RELATED APPLICATIONS

This application seeks priority to U.S. Provisional Application 61/270,236, filed Jul. 6, 2009, the entirety of which is incorporated by reference.

FIELD OF THE INVENTION

The present invention relates to musical instruments. More specifically, the invention relates to a positional constant string pitch control system for anchoring, tuning and controlling pitch of a string or strings. An additional function of the position constant string pitch control system is to control variations in string pitch, including tremolo and vibrato. An additional function of the position constant string pitch control mechanism is to control intonation, i.e., dimensional orientation of a string contact point relative to an appropriate intonation harmonic.

BACKGROUND INFORMATION

The following terms are used in conjunction with this application and are provided herewith for definition.

Intonation Point—A string contact point located at an appropriate intonation harmonic.

Extra-harmonic—Tensioned string that is not directly employed between played intonation points.

Bridge—An intonation point that couples primary string vibration to the soundboard.

Soundboard—The portion of the instrument coupled to the bridge that acoustically amplifies primary string vibration.

Body—The structure of the instrument that is not the neck, and to which the string is anchored, opposite the neck.

Neck—The portion of the instrument that is not the body, around which the fretting hand of the musician is wrapped during play, and against which the musician presses the string (or above which for harmonics or slide) in order to sound a note.

Nut—An intonation point located on the neck, farthest from the bridge.

Tuner—A device with adjustable fixed tension required to bring and hold a slack string taut to a stable given tuned pitch.

Fine Tuner—A device with adjustable fixed tension that slightly modifies the stable given pitch of a taut tuned string.

Tremolo (or Vibrato)—A device to impart reciprocal or variable motion intended to waver pitch of a taut tuned string.

Problems with Controls

Conventional string pitch adjustment control surfaces, i.e., manually manipulated input controls, are undifferentiated string to string, causing errors during attempted tuning adjustments in low light or performance environments. Collectively mounted units are limited by string center-to-center measurements, requiring considerable dexterity to adjust without disturbing adjacent control surfaces.

Conventional tuning techniques require significant agility to tension a string to pitch. Two conventional tuning formats exist, differentiated by location:

a. Headstock mounted technologies require the musician to disengage the fretting hand from fingering notes in order to tune, or require the musician to reach awkwardly with the plucking, bowing or strumming hand across the musician's body to the tuning end of the neck.

b. Conventional body mounted technologies are fixedly positioned such that string pitch adjustment control surfaces require the musician to reach awkwardly with the fretting hand, if that method of tuning is desired, or conform to the control surface location and orientation—relative to the string plane—with the plucking, bowing or strumming hand.

Problems with String Forces

Conventional metal string anchoring mechanisms require use of ball end strings, i.e., attachment end strings, so that the strings may be tensioned to pitch. Use of these proprietary strings is expensive and restrictive for users. Conventional methods of attaching plain end metal strings employ a single clamping point, often combined with a dramatic string bend, both of which provide opportunities for string fatigue and catastrophic failure. Conventional acoustic instruments using gut or nylon strings, i.e., non-metal strings—which are more fragile, in comparison to metal strings—and require a system of knots or a capstan arrangement with string windings to anchor or tune provide opportunities for the string to fray or slip, causing breakage or detuning. Conventional string tensioning systems are mutually exclusive, regarding use of metal or non-metal strings.

Conventional string tensioning systems require the string to have dramatic bends—including tangential, lateral or coil—along its length. These dramatic bends, combined with repeated tensioning and de-tensioning due to tuning and tremolo or vibrato use, place excessive stress on the strings, often ending in catastrophic destruction of the string.

Conventional string tuning technologies require one or a combination of four mechanical principles, in order to gain mechanical advantage (leverage) over longitudinal string tension, and are categorized as simple machines:

a. Gears used in conventional technologies have significant problems, including manufacturing complexity and gear slip. Strings must be tuned flat then retuned to pitch in order to eliminate play and friction. Examples include: worm, planetary, spur, bevel, helical, etc. Gears, combined with shafts, additionally impart significant longitudinal, tangential, or lateral string displacement.

b. Screws used in conventional technologies have significant problems including mechanical disadvantage, in comparison to other simple machines, due to friction and limited mechanical advantage determined by thread pitch. Considerable finger strength is required to perform pitch adjustments. Screws, used alone, additionally impart significant longitudinal, tangential, or lateral string displacement.

c. Pulleys used in conventional technologies have significant problems, including manufacturing complexity and longitudinal string stretch. Strings must be positioned through at least one of a series of at least 180 degree curved surfaces comprised of an axle and shaft. The greater the length of extra-harmonic string, i.e., not directly employed between played intonation points, the greater the opportunity for undesired detuning.

d. Levers used in conventional technologies have significant problems, including longitudinal, tangential, and lateral displacement of the string. As the lever extends, string displacement increases. Class 2 and Class 3 levers exhibit additional string deviation and mechanical instability, compared to Class 1 levers, because the load and fulcrum are not proximate, or because the force is remote from the fulcrum.

There are significant problems with conventional lever, i.e., lever arm, tuning technologies that include:

a. Use of a rotatable ring with a tangentially extended lever arm that requires a pre-tensioning device mounted integral to, or independent of, the lever arm. The pre-tensioning device adds additional weight, complexity, and extra-harmonic opportunity for undesired string slip, detuning or catastrophic failure.

b. Use of a pulley or wheel rotatably mounted in a lever arm requires a pre-tensioning or tuning device mounted integral to, or independent of, the lever arm. The pre-tensioning or tuning device adds additional weight, complexity and extra-harmonic opportunity for undesired string slip, detuning or catastrophic failure. The rotatably mounted pulley or wheel introduces undesired mechanical noise, opportunity for wear, movement, potential lateral string deviation, and depriving string vibrational transfer, degrading tone.

c. A rotating surface over which the string attached to a tuning lever is stretched and which moves with the string as the tension of the string is adjusted, combined with use of a tuning mechanism that requires a pre-tensioning tuning device, or additional tuning device, including a fine tuner, or any string anchor point that is not the rotating string contact surface, has extra-harmonic string length between the tuning or anchoring point and the string contact surface that is subject to stretch, stress, and therefore detuning.

d. Also, a rotating surface over which the string attached to a tuning lever is stretched and which does not move with the string as the tension of the string is adjusted, combined with use of a tuning mechanism that requires a pre-tensioning tuning device, or additional tuning device, including a fine tuner, or any string anchor point that is not the rotating string contact surface, has extra-harmonic string length between the tuning or anchoring point and the string contact surface that is subject to stretch, stress, friction, and therefore detuning.

Conventional lever, i.e., lever arm, tuning technologies used as a tuning-bridge have significant problems that include:

a. A collective—i.e., a plurality mounted side-by-side on an axle perpendicular to the neck and each in a line—mounted lever arm assembly is incapable of longitudinal adjustment to compensate for individual string intonation inaccuracies. Accurate intonation varies from string to string, depending upon variables including string scale length, string gauge, and string material. Fixed position intonation points are necessarily a compromise solution due to variables including string choice, thermal expansion due to temperature and humidity change, instrument manufacture or adjustment, and lead to discordant and undesired pitch errors.

b. A lever fixedly mounted to the supporting structure is by definition incapable of longitudinal adjustment to compensate for intonation inaccuracies.

c. Collectively mounted levers and fixedly mounted levers are incapable of independent adjustment for string action, i.e., string height above the fingerboard, or for string position relative to the fingerboard and adjacent strings, i.e., string spacing. These adjustments are necessary for the comfort of the musician and the playability of the instrument.

d. A rotatable ring or wheel or circular string contact intonation point surface, with equal radiuses, is not in itself variable in relation to the string contact point, without affecting intonation or string action. This invariability requires compensatory adjustments by components of the system that are not the rotatable ring, and therefore subject to additional complexity as well as inaccuracies, in relation to the intonation point.

Problems with Tremolo

There are significant problems with conventional tremolo systems that include:

a. Fulcrum tremolo systems that include an intonation point detune during pitch change because the location of the string intonation point is independent of the fulcrum point. As the fulcrum pivots, the string contact point describes an arc, relative to the appropriate intonation harmonic. Because each string intonation point is necessarily different, the arcs described by multiple strings differ, causing relative string-to-string detuning. The string contact point arc also causes changes in string action, i.e., string height above the fingerboard, or string position relative to the fingerboard. Fulcrum tremolo systems that employ an intonation point independent of the fulcrum mechanism necessarily require extra-harmonic string length between the appropriate intonation point and fulcrum string contact point and are therefore subject to string stretch, and detuning. Detuning and string action changes are not controllable by the musician, stifling creative expression.

b. Conventional cam tremolo systems that employ an independent intonation point, or bridge, that is not the surface of the cam, have extra-harmonic string length between the intonation point and the surface of the cam that is subject to stretch, and therefore detuning. Detuning and string stretch changes are not controllable by the musician, therefore stifling creative expression.

c. Conventional lever, i.e., lever arm, tuning technologies used as a tuning-bridge and collectively mounted—e.g., a plurality mounted side-by-side on an axle perpendicular to the neck and each in a line—have necessarily predetermined string-to-string relative pitch change during tremolo or vibrato. Fixedly mounted levers are by definition not adjustable for string-to-string relative pitch change. String-to-string relative pitch changes not controllable by the musician stifle creative expression.

d. Conventional tremolo technologies, including those that are not fulcrum or cam—which restrict musicians to mutually exclusive conditions, including: string-to-string accurate relative pitch change, or string-to-string inaccurate (detuning) relative pitch change—stifle creative expression.

Conventional tremolo technologies are further deficient in the application of spring technologies used to offset longitudinal string tension. Typically the musician applies manual force to the tremolo to deviate the tuned pitch. An arrangement of spring or springs is conventionally used to counteract the increasing input force of the musician, and the decreasing longitudinal force of the string or strings, when the tremolo is manipulated flat, the objective to return the instrument to correct tuned pitch, i.e., pitch neutral. As the tremolo is manipulated flat, the spring or springs elongate (uncoil) in an extension arrangement, or contract (coil) in a compression arrangement. As strings are manipulated beyond tuned pitch, i.e., sharp, string elongation occurs, increasing longitudinal force and causing the strings to seek return to pre-manipulation tension. Strings are designed to predictably stretch then return to previous length, the accuracy of that return a factor used to evaluate string quality. Elongation or compression of a spring and elongation of strings are both a linear progression of force, following Hooke's law of elasticity.

Significant Problems Include:

a. Conventional tremolo spring arrangements are linear force progression systems, examples include: use of one spring per string; use of one spring per group of strings; use of one spring in total; use of springs in force parallel; use of parallel mounting for equal load springs, etc., i.e., use of any arrangement of springs that results in linear force progression. Linear force progression systems in equilibrium are subject to harmonic oscillation. Harmonic oscillation causes pitch fluctuation. Input into a linear force progression system in equilibrium—including sounding a note—causes the pitch to waver, i.e., detune. Also, harmonic oscillation slows return to pitch neutral. Additionally, as oppositional forces cause the system to seek equilibrium, longitudinal string movement in relation to the intonation point decreases musical sustain.

b. Conventional tremolo spring arrangements constrained parallel to the longitudinal string path have increased susceptibility to harmonic oscillation.

c. Spring noise occurs in tremolo systems as springs elongate or compress. These non-musical noises are structurally transmitted and audible, or amplified. The greater the spring distortion, the greater the spring noise. Examples include: stressed spring mounts, deforming spring material, spring coil contact, etc.

d. Conventional spring arrangements exclusively constrained within or without the longitudinal string path—including extension, compression or torsion springs, etc., and parallel, perpendicular or tangential spring mounting—subject the tremolo system to torsional distortion if the tremolo input device, i.e., lever ("whammy bar"), is asymmetrically located remote from the equilibrium point of the contradictory forces. Thus the act of input causes torsional distortion to the system, degrading performance and increasing wear.

e. Conventional tremolo spring arrangements are attached to the main body of the tremolo unit, or to the base of the input device, i.e., lever ("whammy bar"). This location proximate the equilibrium point of the contradictory forces requires additional leverage, compared to location distant.

f. Conventional location for tremolo input devices, i.e., lever ("whammy bar"), is above—in relation to the neck—the plane of the strings. This location interferes with the arc described by the hand of the musician during play.

g. Conventional tremolo systems limited to linear force progression also limit kinesthetic experiences for the musician, thereby stifling creativity.

Problems with Mounting & Soundboard

Conventional body mounted string pitch control technologies, e.g., tuner, tuning-bridge, bridge, tremolo or vibrato, use a front mounted placement. Strings contact the pitch control mechanism, and contact is maintained through string direction change (tangential, lateral), relative to the length of the string (longitudinal), or through neutral tension technologies. Three conventional pitch control mechanism formats exist, differentiated by string termination points: downward force, attachment point and neutral tension technologies:

a. Conventional downward force pitch control mechanisms use downward force (tangential, lateral)—against the front of the instrument—to couple the string or pitch control mechanism to the soundboard. Longitudinal string tension is redirected tangentially, or laterally. Examples include: violin, cello, archtop guitar, etc.

b. Conventional attachment point pitch control mechanisms terminate strings on the soundboard, either as part of the pitch control mechanism, or independently located. Longitudinal string tension is applied directly to the soundboard, either longitudinally, tangentially, or laterally. Examples include: acoustic guitar, electric guitar & bass, etc.

There are significant problems with conventional technologies that include:

a. Both downward force and attachment point pitch control mechanisms restrict soundboard and string vibration due to string tension applied directly to the soundboard: the higher the pitch, for a given string, the greater the tension applied to the soundboard. The greater the tension, the greater the vibrational restriction, for both soundboard and string. Restricted string and soundboard vibration results in reduced musical sensitivity, sustain, and harmonic detail.

b. In order to counteract string tension applied to the soundboard, various bracing schemes have been devised. Every form of soundboard bracing adds mass to the soundboard, slowing directional change, and restricting vibrational movement. Additional bracing requires additional material, maintenance and expense, as well as opportunities for joint fatigue or failure.

c. Conventional technologies are particularly vulnerable to changes in string tension or environmental temperature and humidity. Because string pitch (tuning and intonation) is directly dependent upon string coupling to the soundboard, any alteration to the geometry or relationship between the string and soundboard interactively affects tuning, intonation, and the structural integrity of the instrument.

There is a need to provide a string pitch control system that does not require significant agility or strength for an individual to use.

There is a need to provide a technology to allow for an individual to self-determine and adjust the orientation of the string pitch control surfaces relative to the string plane.

There is a need to provide a pitch adjustment control surface to visually, and through tactile sensation, easily distinguish and differentiate between control surfaces associated with specific individual strings.

There is a need for pitch adjustment control surfaces technology that allows for individual or collective controls to be locked, i.e., fixed in position, once the string has been tuned.

There is a further need for pitch adjustment control surfaces technology that allows for surfaces to vary in size or shape or be detached from the instrument, once the string has been tuned.

There is a need to provide a string anchoring system that facilitates a variety of string end configurations, including plain end strings, as well as different string material types.

There is a need to provide a string anchoring mechanism that does not create the opportunity for catastrophic string failure at a single point.

There is a need to provide a string tensioning system that does not position the string in geometries that cause excessive stress on the string.

There is a need to provide a string tensioning system that does not require extra-harmonic string length.

There is a need to provide a string tuning technology that is simple to manufacture, offers significant mechanical advantage, is mechanically stable, and greatly reduces longitudinal, tangential, or lateral string displacement, in comparison to conventional technologies.

There is a need to provide a lever tuning mechanism that will allow the string to be simply anchored and accurately tuned, i.e., bringing and holding a slack string taut to a stable given pitch, without requiring pre-tensioning tuning devices, or additional tuning devices, including fine tuners.

There is a need to provide a lever tuning technology that will allow for use as an adjustable intonation point, or as a bridge, and that will facilitate simple adjustment for: string intonation, string height above the fingerboard, and string spacing.

There is a further need to provide a lever tuning technology that will allow for use as an adjustable intonation point, or as a bridge, and that greatly reduces—in comparison to conventional technologies—longitudinal, tangential, or lateral string displacement, in relation to an intonation point.

There is a need to provide a tremolo technology that does not require extra-harmonic string length.

There is a need to provide a tremolo technology that does not position the string in geometries that cause excessive stress on the string.

There is a need to provide a tremolo technology that dissociates, or greatly reduces—in comparison to conventional technologies—longitudinal, tangential, and lateral displacement of the string, when used independently of the intonation point.

There is a need to provide a tremolo technology that allows for use as an adjustable intonation point, or as a bridge, and yet dissociates, or greatly reduces—in comparison to conventional technologies—longitudinal, tangential, and lateral displacement of the string.

There is a further need to provide a tremolo technology that allows for use as an intonation point, or as a bridge, and that simply allows for bringing and holding a slack string taut to a stable given pitch, i.e., tuning, without requiring independent pre-tensioning tuning devices, or additional tuning devices, including fine tuners.

There is a further need to provide a tremolo technology that does not require an independent intonation point, or bridge, and that simply allows for bringing and holding a slack string taut to a stable given pitch, i.e., tuning, without requiring independent pre-tensioning tuning devices, or additional tuning devices, including fine tuners.

There is a further need to provide a tremolo technology that simply allows for bringing and holding a slack string taut to a stable given pitch, i.e., tuning, without requiring independent pre-tensioning tuning devices, or additional tuning devices, including fine tuners.

There is a need for a tremolo mechanism that greatly dampens or decreases harmonic oscillation—in comparison to conventional technologies—thus reducing uncontrolled pitch fluctuation or waver.

There is further a need for a tremolo mechanism that more rapidly—in comparison to conventional technologies—seeks equilibrium, thus reducing pitch fluctuation.

There is also a need for a tremolo mechanism that suppresses spring noise, and spring mount associated noise.

There is also a need for a tremolo mechanism less subject—in comparison to conventional technologies—to torsional distortion.

There is a further need for a tremolo mechanism that is not limited to linear force progression.

There is also a need for a tremolo input device that is less obtrusive—in comparison to conventional technologies—to the musician during play.

There is a need for a tremolo technology capable of providing musicians with controllable string-to-string relative pitch changes.

There is a need for a string pitch control mechanism to allow for greatly disassociated—in comparison to conventional technologies—longitudinal, tangential, and lateral string tension forces from the soundboard.

There is a further need for a string pitch control mechanism that allows the soundboard to be designed in such a manner as to remain independent of necessity to withstand longitudinal (including tangential and lateral) string tension.

There is also a need for a string pitch control mechanism to simply adjust the relationship between string and fingerboard, thus affecting playability (force required to fret a note at a given pitch) and intonation, without requiring interactive adjustments to the soundboard, soundboard bracing, or neck (fingerboard) angle in relation to the soundboard or pitch control mechanism.

There is a need for a string pitch control mechanism to facilitate soundboard designs that require less structural bracing.

There is a need for a string pitch control mechanism to facilitate soundboard designs that require less mass.

SUMMARY OF THE INVENTION

It is an objective of an aspect of the invention to provide a technology to allow force to be placed upon a string such that does not require significant agility or strength for an individual to use. This will facilitate play and performance by musicians of varied: body size, shape, age, dexterity, etc.

It is an objective of an aspect of the invention to provide a technology to allow for an individual to self-determine and adjust the orientation of the string pitch control surfaces relative to the string plane thereby facilitating play and performance by musicians of varied: body size, shape, age, dexterity, etc. This will also make performance and play more comfortable for the musician.

It is an objective of an aspect of the invention to provide a pitch adjustment control surface to visually, and through tactile sensation, easily distinguish and differentiate between control surfaces associated with specific individual strings. This will reduce tuning errors during low light and performance situations.

It is an objective of an aspect of the invention to provide pitch adjustment control surfaces in a staggered or interlocking arrangement. This will facilitate pitch adjustment without disturbing adjacent control surfaces, and reduce space required by the control surfaces.

It is an objective of an aspect of the invention to provide pitch adjustment control surfaces technology that is configured to allow for individual or collective controls to be locked, i.e., fixed in position, once the string has been tuned. This configuration will reduce the potential for detuning, and allow the musician to concentrate on play.

It is an objective of an aspect of the invention to provide pitch adjustment control surfaces technology that allows for surfaces to vary in size or shape or be detached from the instrument, once the string has been tuned. This technology will reduce the potential for detuning, and allow the musician to concentrate on play.

It is an objective of an aspect of the invention to provide a string anchoring system that facilitates a variety of string end configurations, including plain end strings, as well as different string material types. This will increase string options for the musician and reduce the cost of strings by easing dependence on proprietary strings.

It is an objective of an aspect of the invention to provide a string clamping mechanism integral to the string pitch control mechanism to simply attach a plain string, without the necessity of a ball-end string or anchoring device integral to the string. This will facilitate use of conventional, commercially available, nonproprietary strings.

It is an objective of an aspect of the invention to provide a string anchoring mechanism that does not create the opportunity for catastrophic string failure at a single point. This will extend play time, allow greater range of pitch bend expression, improve string performance over time, and reduce costs by requiring fewer string replacements.

It is an objective of an aspect of the invention to provide a string tensioning system that does not position the string in geometries that cause excessive stress on the string, including lateral, tangential or coil forces. This will extend play time, allow greater range of pitch bend expression, improve string performance over time, and reduce costs by requiring fewer string replacements.

It is an objective of an aspect of the invention to provide a string tensioning system that does not require extra-harmonic string length. This will reduce opportunities for string stretch, stress, detuning, or catastrophic failure.

It is an objective of an aspect of the invention to provide a tuning mechanism that will allow the string to be simply anchored and accurately tuned, i.e., bringing and holding a slack string taut to a stable given pitch, without requiring pre-tensioning tuning devices, or additional tuning devices, including fine tuners. This will simplify manufacturing complexity, reduce weight, and reduce potential for undesired detuning.

It is an objective of an aspect of the invention to provide a string tuning technology that is simple to manufacture, offers significant mechanical advantage, is mechanically stable, and greatly reduces longitudinal, tangential, or lateral string displacement, in comparison to conventional technologies, e.g., positional constant. This will decrease manufacturing costs, improve the quality and experience of tuning for musicians, and greatly simplify adjustments regarding string intonation and playability, thus saving time and extending play.

It is an objective of an aspect of the invention to provide a lever tuning mechanism that will allow the string to be simply anchored and accurately tuned, i.e., bringing and holding a slack string taut to a stable given pitch, without requiring pre-tensioning tuning devices, or additional tuning devices, including fine tuners. This will decrease manufacturing costs, improve the quality and experience of tuning for musicians, and greatly simplify adjustments regarding string tuning, thus saving time and extending play.

It is an objective of an aspect of the invention to provide a lever tuning technology that will allow for use as an adjustable intonation point, or as a bridge, and that will facilitate simple adjustment for positional constant: string intonation, string height above the fingerboard, and string spacing. This will decrease manufacturing costs, improve the quality and experience of tuning for musicians, and greatly simplify adjustments regarding string intonation and playability, thus saving time and extending play. This will also improve string vibration transfer, and tone, by eliminating multiple linkages required in the mechanical structure.

It is an objective of an aspect of the invention to provide a lever tuning technology that will allow for use as an adjustable intonation point, or as a bridge, and that greatly reduces—in comparison to conventional technologies—longitudinal, tangential, or lateral string displacement, in relation to an intonation point, e.g., positional constant. This will decrease manufacturing costs, improve the quality and experience of tuning for musicians, and greatly simplify adjustments regarding string intonation and playability, thus saving time and extending play.

It is an objective of an aspect of the invention to provide a mechanism to control pitch of a stringed musical instrument—including tuning, tremolo and vibrato, and allow for use as an adjustable intonation point, or as a bridge—yet dissociate, or greatly reduce in comparison to conventional technologies, longitudinal, tangential, and lateral displacement of the string, e.g., positional constant. Benefits may include:

a. Dissociative—or greatly reduced, in comparison to conventional technologies—interactive variability in relationships or geometry between string pitch (tuning and intonation) and longitudinal, tangential and lateral displacement of the string, due to string tension changes, e.g., positional constant.

b. Greater freedom to locate the tuning system, including on the neck or body of the stringed instrument.

It is an objective of an aspect of the invention to provide a string pitch control mechanism that allows the strings to be tuned and pitch manipulated independently, or collectively. This will enhance precise control over pitch yet facilitate tremolo and vibrato.

It is an objective of an aspect of the invention to provide a string pitch control mechanism that allows the strings to be tuned and pitch manipulated independently, as well as collectively. This will enhance precise control over pitch yet facilitate tremolo and vibrato.

It is an objective of an aspect of the invention to provide a string pitch control mechanism to facilitate location independent of other strings, and in relation to the intonation length of the string. This will simplify design of variable string length instruments, e.g., fanned fret (multi-scale).

It is an objective of an aspect of the invention to provide a string pitch control mechanism to facilitate longitudinal, tangential and lateral adjustment of the string pitch control mechanism in relation to the string. This will simplify adjustment of the string pitch control mechanism in relation to the bridge, and allow for the tuning mechanism to be used as an intonation point, or as a bridge, e.g., positional constant.

It is an objective of an aspect of the invention to provide a string pitch control mechanism to facilitate string self-alignment in relation to the bridge or neck, e.g., positional constant. This will reduce friction and string breakage.

It is an objective of an aspect of the invention to provide a string pitch control mechanism to facilitate use as an intonation point, in addition to controlling and adjusting string tension. This will allow for the string pitch control mechanism to function as a bridge or nut.

It is an objective of an aspect of the invention to provide a mechanism that will allow for pitch control of a vibrating string in a stringed instrument and to couple the vibration of the string to the soundboard.

It is an objective of an aspect of the invention to provide a string pitch control mechanism to facilitate tremolo and vibrato adjustments with greatly reduced—in comparison to conventional technologies—need for disassembly of the instrument or access independent of the string pitch control mechanism. This will facilitate and simplify construction, maintenance and adjustment while reducing mechanical failure opportunities.

It is an objective of an aspect of the invention to provide a tremolo technology that does not require extra-harmonic string length. This will reduce opportunities for string stretch, stress, detuning, or catastrophic failure. This will also extend play time, allow greater range of pitch bend expression, improve string performance over time, and reduce costs by requiring fewer string replacements.

It is an objective of an aspect of the invention to provide a tremolo technology that does not position the string in geometries that cause excessive stress on the string. This will extend play time, allow greater range of pitch bend expression, improve string performance over time, and reduce costs by requiring fewer string replacements.

It is an objective of an aspect of the invention to provide a tremolo technology that dissociates, or greatly reduces—in comparison to conventional technologies—longitudinal, tangential, and lateral displacement of the string, when used independently of the intonation point, e.g., positional constant. This will reduce opportunities for string stretch, stress, detuning, or catastrophic failure.

It is an objective of an aspect of the invention to provide a tremolo technology that allows for use as an adjustable intonation point, or as a bridge, and yet dissociates, or greatly reduces—in comparison to conventional technologies—longitudinal, tangential, and lateral displacement of the string contact point, e.g., positional constant. This will decrease manufacturing costs, improve the quality and experience of tuning for musicians, and greatly simplify adjustments regarding string intonation and playability, thus saving time and extending play.

It is an objective of an aspect of the invention to provide a tremolo technology that allows for use as an intonation point, or as a bridge, and that simply allows for bringing and holding a slack string taut to a stable given pitch, i.e., tuning, without requiring independent pre-tensioning tuning devices, or additional tuning devices, including fine tuners. This will decrease manufacturing costs, improve the quality and experience of tuning for musicians, and greatly simplify adjustments regarding string intonation and playability, thus saving time and extending play. This will also improve string vibration transfer, and tone, by eliminating multiple linkages required in the mechanical structure.

It is an objective of an aspect of the invention to provide a tremolo technology that does not require an independent intonation point, or bridge, and that simply allows for bringing and holding a slack string taut to a stable given pitch, i.e., tuning, without requiring independent pre-tensioning tuning devices, or additional tuning devices, including fine tuners. This will decrease manufacturing costs, improve the quality and experience of tuning for musicians, and greatly simplify adjustments regarding string intonation and playability, thus saving time and extending play. This will also improve string vibration transfer, and tone, by eliminating multiple linkages required in the mechanical structure.

It is an objective of an aspect of the invention to provide a tremolo technology that simply allows for bringing and holding a slack string taut to a stable given pitch, i.e., tuning, without requiring independent pre-tensioning tuning devices, or additional tuning devices, including fine tuners. This will decrease manufacturing costs, improve the quality and experience of tuning for musicians, and greatly simplify adjustments regarding string intonation and playability, thus saving time and extending play. This will also improve string vibration transfer, and tone, by eliminating multiple linkages required in the mechanical structure.

It is an objective of an aspect of the invention to provide a tremolo mechanism that greatly dampens or decreases harmonic oscillation—in comparison to conventional technologies—thus reducing uncontrolled pitch fluctuation or waver. This will ease and simplify tuning, enhance pitch accuracy, musical sustain, transient detail, overtone, and note articulation amplification.

It is an objective of an aspect of the invention to provide a tremolo mechanism that more rapidly—in comparison to conventional technologies—seeks equilibrium, thus reducing pitch fluctuation. This will ease and simplify tuning, enhance pitch accuracy, musical sustain, transient detail, overtone, and note articulation amplification.

It is an objective of an aspect of the invention to provide a tremolo mechanism that suppresses string tension offset spring noise, and spring mount associated noise. This will improve signal-to-noise ratio and tone.

It is an objective of an aspect of the invention to provide a tremolo string tension spring mechanism that can more equally distribute—in comparison to conventional technologies—force imbalance between string tension offset springs and tremolo input device, i.e., lever ("whammy bar") forces.

It is an objective of an aspect of the invention to provide a tremolo mechanism less subject—in comparison to conventional technologies—to torsional distortion, thus reducing wear and improving performance.

It is an objective of an aspect of the invention to provide a tremolo mechanism that is not limited to linear force progression, thus enhancing opportunity for creative expression by the musician.

It is an objective of an aspect of the invention to provide a tremolo input device that is less obtrusive—in comparison to conventional technologies—to the musician during play. This will facilitate instrument designs more comfortable for the musician.

It is an objective of an aspect of the invention to provide a tremolo technology capable of providing the musician with controllable string-to-string relative pitch changes, thus enhancing opportunity for creative expression by the musician.

It is an objective of an aspect of the invention to provide a string pitch control mechanism to allow for greatly disassociated—in comparison to conventional technologies—longitudinal, tangential, and lateral string tension forces from the soundboard, e.g., neutral tension.

It is an objective of an aspect of the invention to provide a string pitch control mechanism that allows the soundboard to be designed in such a manner as to remain independent of the necessity to withstand longitudinal (including tangential and lateral) string tension, e.g., neutral tension. Building upon the previous paragraph, the soundboard can disassociate from structural necessity, i.e., function independently of form, shape, size, configuration, integrity, and design issues related to the remainder of the instrument.

It is an objective of an aspect of the invention to provide a string pitch control mechanism to simply adjust the relationship between string and fingerboard, thus affecting playability (force required to fret a note at a given pitch) and intonation, without requiring interactive adjustments to the soundboard, soundboard bracing, or neck (fingerboard) angle in relation to the soundboard or pitch control mechanism.

It is an objective of an aspect of the invention to provide a string pitch control mechanism to facilitate soundboard designs that require less structural bracing, thus simplifying construction, maintenance, and reducing mechanical failure opportunities.

It is an objective of an aspect of the invention to provide a string pitch control mechanism to facilitate soundboard designs that require less mass, thus increasing the directional vibrational responsiveness of the soundboard and enhancing transient detail, overtone, and note articulation amplification.

The objectives of the invention are achieved as illustrated and described. In an embodiment of the invention, the string is anchored to an integral rotatable surface, leveraged to counteract longitudinal string tension. The leveraged rotatable surface allows for non-mutually exclusive determination of string pitch—including intonation, tuning, tremolo and vibrato—without altering the longitudinal, tangential or lateral displacement of the string contact point, e.g., positional constant. The positional constant is a configurable controlled variable. The string pitch control mechanism couples vibration of the string to the soundboard. In an alternate embodiment of the invention, the string pitch control mechanism allows for greatly disassociated—in comparison to conventional technologies—longitudinal, tangential, and lateral string tension forces from the soundboard, e.g., neutral tension.

DETAILED DESCRIPTION

Figure 1:
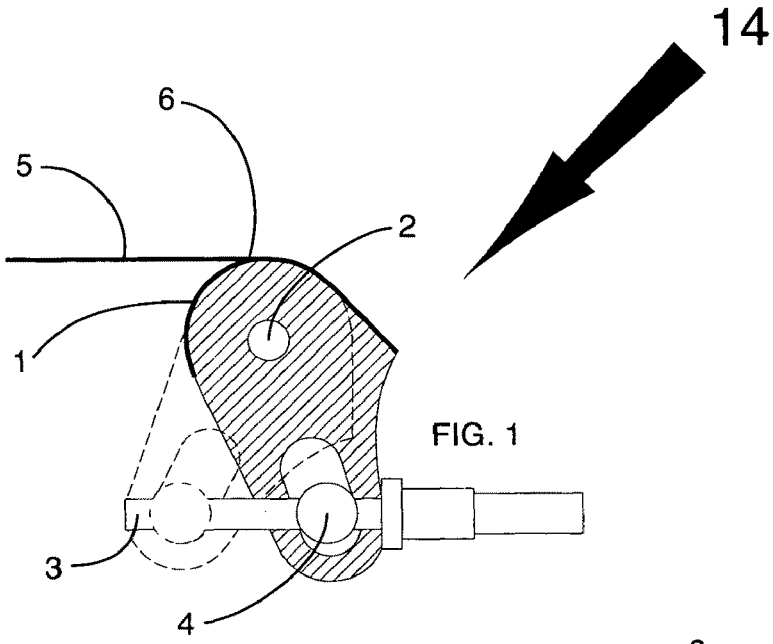
FIG. 1 is a sectional side view of the positional constant string pitch control system in conformance with an embodiment of the invention.

In one embodiment of the invention illustrated in FIG. 1, positional constant string pitch control system 14 comprises a rotatable surface 1 mounted to a pivot point 2. The relationship between the rotatable surface 1 and pivot point 2 can be adjustable. A threaded string pitch adjustment shaft 3, leveraged against longitudinal string tension, actuates a nut 4 to position rotatable surface 1, and thus control string pitch. In an alternate embodiment of the invention, the threaded string pitch adjustment shaft 3 directly actuates the rotatable surface 1, by means of a geared arrangement which can include as non-limiting examples: spur, helical, worm, rack and pinion, etc. The string 5 is anchored to the rotatable surface 1 shaped to control the positional constant 6. The positional constant 6 is defined as the point at which the string 5 departs the rotatable surface 1. The arrangement is a fully adjustable unit that allows for configurable dimensional orientation of the positional constant 6 relative to an appropriate intonation harmonic.

Figure 2:
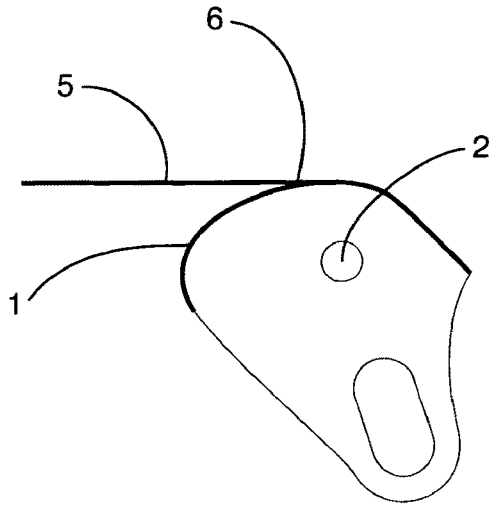
FIG. 2 is a side view of an alternate embodiment of the positional constant string pitch control system of FIG. 1.
Figure 3:
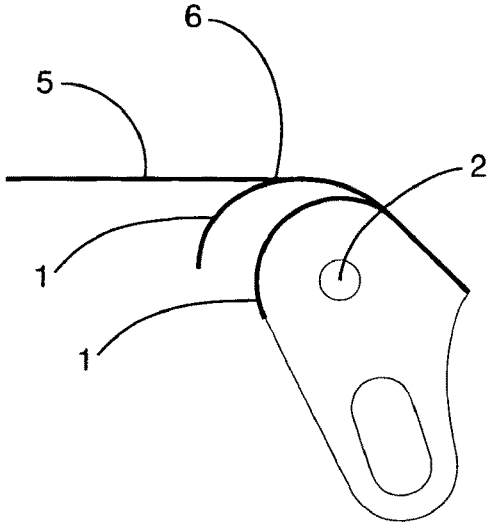
FIG. 3 is a side view of an alternate embodiment of the positional constant string pitch control system of FIG. 1.

The rotatable surface 1 can be a regular or symmetrical shape, or as illustrated in FIG. 2, an irregular or asymmetrical shape. As illustrated in FIG. 3, the rotatable surface 1 can be independently adjustable in relation to the pivot point 2. The size of the rotatable surface 1 can be varied and can be interchangeable, string 5 to string 5.

Figure 4A:
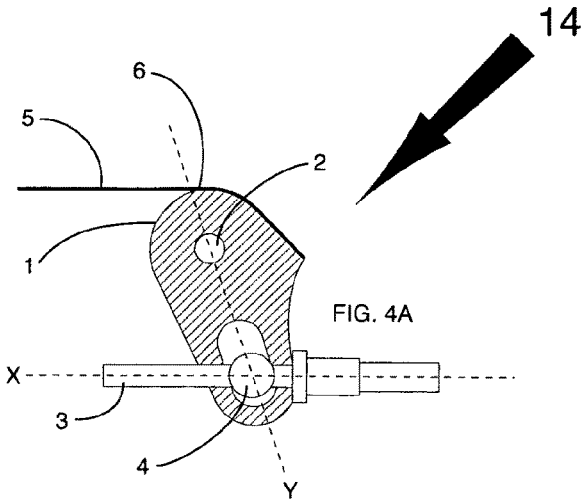
FIG. 4A is a sectional side view of the positional constant string pitch control system of FIG. 1.
Figure 4B:
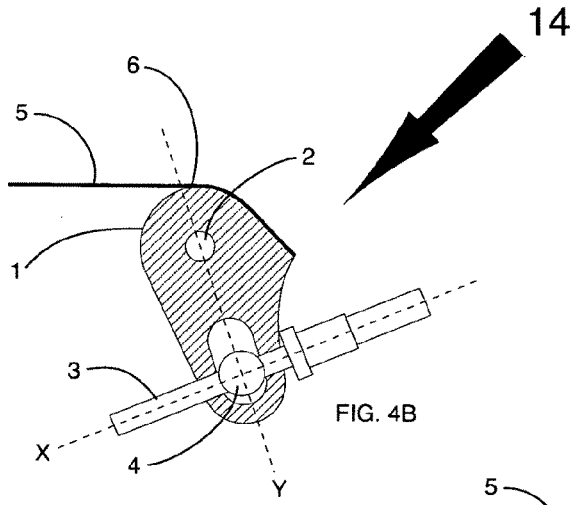
FIG. 4B is a sectional side view of the positional constant string pitch control system of FIG. 1.
Figure 4C:
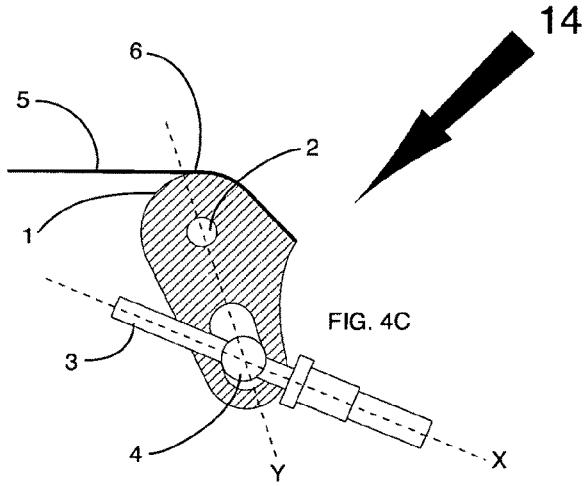
FIG. 4C is a sectional side view of the positional constant string pitch control system of FIG. 1.

As illustrated in FIGS. 4A, 4B and 4C, the axial position of the threaded string pitch adjustment shaft 3 can be varied in relation to the rotatable surface 1—including the relative angles formed by the intersection of the axes, independent of the position of the progression of the intersection of the rotatable surface 1, threaded string pitch adjustment shaft 3, and nut 4—as well as in relation to the plane of the string 5. The nut 4 can be captive or free, and capable of decoupling from the rotatable surface 1. The position, rotation or progression of the nut 4 can be adjustably directed to advantageously transfer leverage from the threaded string pitch adjustment shaft 3 against the rotatable surface 1. As non-limiting examples, the progression of the nut 4 can be a sliding progression: in a line, along a curve, in an arc, etc.

In the illustrated embodiments provided, the positional constant string pitch control system 14 is made of a material that is rugged to allow the positional constant string pitch control system 14 to be capable of holding a string of a stringed instrument without significant bending, warping, or need for servicing. Such materials may be, as non-limiting examples, aluminum, steel, brass, copper, metallic alloys, sturdy plastics and epoxy materials, or wood. In the non-limiting illustrated embodiment, the rotatable surface 1 is made of aircraft grade aluminum to be light weight, yet strong. The rotatable surface 1 can also be a string pickup, i.e., transducer, that can convert string vibrations into electrical signals, of which non-limiting examples include: piezo, microphonic, optical, etc. The pivot point 2 is made of stainless steel for precision, longevity and strength. The threaded string pitch adjustment shaft 3 is made of stainless steel for corrosion resistance and strength, and the nut 4 is made of bronze for smooth bearing properties.

Figure 5:
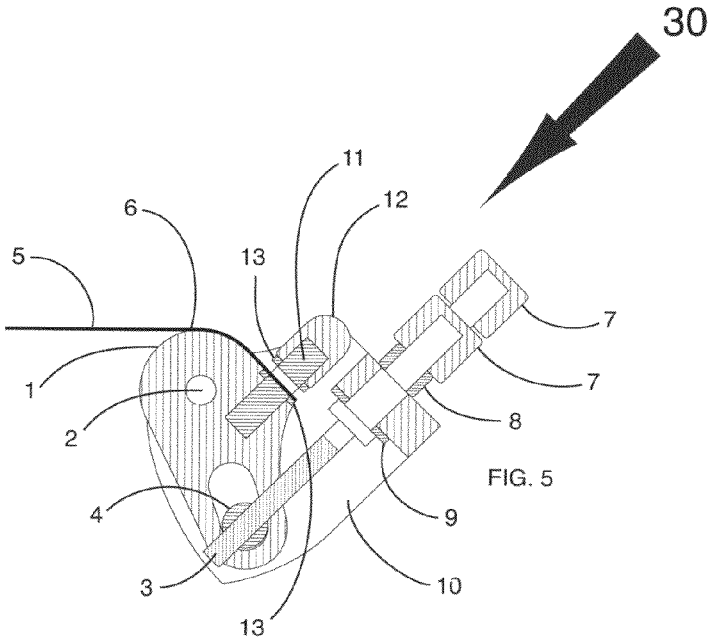
FIG. 5 is an expanded sectional side view of the positional constant string pitch control system in conformance with an embodiment of the invention.

The mounting of the positional constant string pitch control system 14 is accomplished through a connection established with a pivot structure 10, as illustrated in one embodiment of the invention, FIG. 5. The connection between the pivot structure 10 and the pivot point 2 can be both removable and adjustable, including relative position, or location, as well as rotation. In an alternate embodiment of the invention the connection between the pivot structure 10 and pivot point 2 can be contiguous or continuous. The pivot structure 10 can be configured with any appropriate arrangement sufficient to strongly support the pivot point 2, of which non-limiting examples may include: cantilevered, framed, balanced against, pressured contact, tensioned, etc. The pivot point 2 can be configured with any appropriate arrangement sufficient to allow adequate rotation for the rotatable surface 1, of which non-limiting examples may include: bearing, axle, shaft, T-shaft, semicircle, frusto conical, point, knife-edge, etc.

The mounting of the threaded string pitch adjustment shaft 3 is accomplished through a connection established with the bearing 9, as illustrated in one embodiment of the invention, FIG. 5. The bearing 9 can be configured with any appropriate arrangement sufficient to strongly support the threaded string pitch adjustment shaft 3, of which non-limiting examples may include: cantilevered, framed, balanced against, pressured contact, tensioned, etc. The lock collar 8 can be used to adjustably determine the geometric relationship between the threaded string pitch adjustment shaft 3 and the bearing 9, including fixably positioned as illustrated in FIG. 5. In an alternate embodiment of the invention, the lock collar 8 is not employed, or is sufficiently distanced from the bearing 9 such to allow the threaded string pitch adjustment shaft 3 to slide, relative to the bearing 9. The bearing 9 can be contiguous to the pivot structure 10, as illustrated in FIG. 5. In an alternate embodiment of the invention, the bearing 9 can be adjustably attached to the pivot structure 10. In an alternate embodiment of the invention, the bearing 9 can be independent of the pivot structure 10.

In the illustrated embodiments provided, the pivot structure 10 and the bearing 9 are made of a material that is rugged to allow the positional constant string pitch control system 14 to be capable of holding a string of a stringed instrument without significant bending, warping, or need for servicing. Such materials may be, as non-limiting examples, aluminum, steel, brass, copper, metallic alloys, sturdy plastics and epoxy materials, or wood. In the illustrated embodiment FIG. 5, the pivot structure 10 is made of aircraft grade aluminum to be light weight, yet strong. The bearing 9 is made of bronze for smooth bearing properties.

Figure 6:
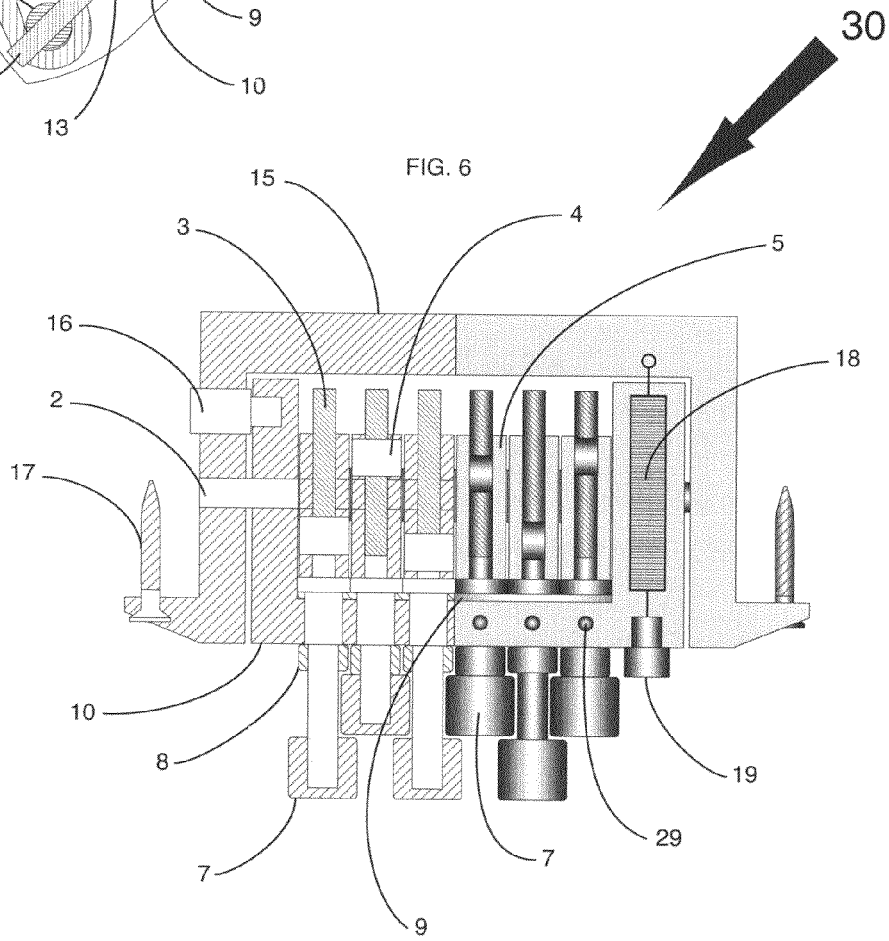
FIG. 6 is an exploded partial sectional bottom view of the positional constant string pitch control system in conformance with an embodiment of the invention.

Referring to expanded sectional side view FIG. 5 and exploded partial sectional bottom view FIG. 6 in conformance with an embodiment of the invention, the string pitch adjustment control surface 7 can be mounted to the threaded string pitch adjustment shaft 3. Surfaces of the string pitch adjustment control surface 7 can be adjacent, overlapping or interlocking. The string pitch adjustment control surface 7 can of different size, shape, material, hardness, texture, color, illuminated, etc., in order to help differentiate. The string pitch control surface 7 can be contiguously formed as integral to the threaded string pitch adjust shaft 3 or it can be independently installable or removable using mechanical means, press fit, threaded or adhesives, as non-limiting examples. The string pitch control surface 7 can be retractable, expandable, or be selectively engaged with a clutch mechanism. The receiving end of the threaded string pitch adjustment shaft 3 can be suitably configured to engage the string pitch control surface 7 including Torx head, Allen head and Phillips head design as non-limiting examples. The threaded string pitch adjustment shaft 3 and the string pitch control surface 7 can be manually or automatically adjusted. The threaded string pitch adjustment shaft 3 and the string pitch control surface 7 can be locked, pressured, clamped or tensioned into a configurable controlled variable specific rotational position, for the purposes of securing or maintaining a given string tension, i.e., pitch, by means of an adjustable pitch lock 29 mechanism, examples of which can include but are not limited to: thumb screw, friction brake, etc.

Referring to expanded sectional side view FIG. 5, the string anchor post 11 is attached to or embedded within the rotatable surface 1. The string anchor post 11 is through drilled of sufficient diameter to accommodate any commercially available string gauge for fretted or fretless hand held stringed instruments, including: guitar, bass, violin, cello, mandolin, and banjo as non-limiting embodiments. The through drilled section of the string anchor post 11 is aligned flush with the rotatable surface 1 such that as the string anchor nut 12 is engageably threaded onto the string anchor post 11, the string 5 is firmly clamped to the rotatable surface 1. The washer 13 can be used in conjunction with the string anchor nut 12 to distribute rotational forces. The washer 13 can be countersunk flush to the rotatable surface 1 to act as a sacrificial surface between the string 5 and the rotatable surface 1. The string anchor post 13 can be shaped with an integral shoulder fulfilling the same sacrificial surface purpose as the washer 13. In an alternate embodiment of the invention, the string anchor post 11 can be contiguously formed as integral to the rotatable surface 1. As illustrated in FIG. 5, the string anchor post 11, the string anchor nut 12, the washer 13 can be of any material capable of holding a tensioned string of a stringed instrument without significant bending, warping, or need for servicing. Such materials may be, as non-limiting examples, aluminum, steel, brass, copper, metallic alloys, sturdy plastics and epoxy materials, or wood. In an alternate embodiment of the invention, the rotatable surface 1 is simply slotted to accept and contain the ball end string, i.e., attachment end string. In an alternate embodiment of the invention, the rotatable surface 1 has a through drilled projection or a sub-surface through drilled hole of sufficient diameter to accommodate any commercially available string gauge, an arrangement in conjunction with an intersecting threaded hole that can engageably accommodate a set screw suitably configured to clamp the string 5, including Torx head, Allen head and Phillips head design as non-limiting examples.

In an alternate embodiment of the invention the pivot structure 10 can be mounted to a mounting structure 15, as illustrated in exploded partial sectional bottom view FIG. 6. The connection between the pivot structure 10 and the mounting structure 15 can be both removable and adjustable, including relative position, or location, as well as rotation, forming a nested, adjacent or adjoining assembly as illustrated in an embodiment of the positional constant string pitch control system 30. In an alternate embodiment of the invention the connection between the pivot structure 10 and the mounting structure 15 can be contiguous or continuous. The pivot point 2 arrangement can be a shared arrangement between the rotatable surface 1 and the pivot structure 10 and the mounting structure 15, as illustrated in FIG. 6, or the arrangement can be at least one of a pivot point 2 or pivot points 2 configured with at least one of a pivot structure 10 or structures 10 configured with at least one of a mounting structure 15 or mounting structures 15, with the objective of facilitating controlled positional constant surface rotation. The pivot structure 10 and mounting structure 15 can be configured with any appropriate arrangement sufficient to strongly support the pivot point 2 or pivot points 2, of which non-limiting examples may include: cantilevered, framed, balanced against, pressured contact, tensioned, etc. The pivot point 2 or pivot points 2 can be configured with any appropriate arrangement sufficient to allow adequate rotation for the rotatable surface 1, of which non-limiting examples may include: bearing, axle, shaft, T-shaft, semicircle, frusto conical, point, knife-edge, etc.

In the illustrated embodiments provided, the pivot structure 10 and the mounting structure 15 are made of a material that is rugged to allow the positional constant string pitch control system 30 to be capable of holding a string of a stringed instrument without significant bending, warping, or need for servicing. Such materials may be, as non-limiting examples, aluminum, steel, brass, copper, metallic alloys, sturdy plastics and epoxy materials, or wood. In the illustrated embodiment FIG. 6, the pivot structure 10 and the mounting structure 15 are made of aircraft grade aluminum to be light weight, yet strong. The pivot point 2 is made of stainless steel for precision and smooth bearing properties.

To control relative position or positions between the pivot structure 10 and the mounting structure 15, or between at least one of the pivot structure 10, a rotational arrestor 16 can be used, as illustrated in FIG. 6. The rotational arrestor 16 can be manually or automatically adjusted or engaged, with the objective of facilitating controlled positional constant surface rotation. In one embodiment of the invention, the rotational arrestor 16 can be two attracting magnets, one embedded in the pivot structure 10 and the other embedded in the mounting structure 15, such that their proximity influences the force necessary to adjust the relationship between said components. This will reduce harmonic oscillation and decrease pitch equilibrium return times when the positional constant string pitch control system 30 is used for tremolo or vibrato. In an alternate embodiment of the invention, the rotational arrestor 16 can be a clamp. In another non-limiting embodiment, the rotational arrestor can be a spring loaded pin that engages a hole or series of holes. Other configurations are possible and the arrangements described should be considered non-limiting.

The mounting of the positional constant string pitch control system 30 is accomplished through a connection established on the body 23 or neck 24 of the instrument. The connection in the illustrated embodiment is a mounting screw 17. The mounting screw 17 can be configured with any threading necessary to provide proper connection to the neck 24 or body 23 of the instrument. The head of the mounting screw 17 may be a standard flat head connection, Torx head, Allen head or Phillips head design, as non-limiting examples. The head of the mounting screw 17 may directly contact a mounting surface of the positional constant string pitch control system 30 to evenly distribute the force from the positional constant string pitch control system 30 to the contact surface at the neck 24 or body 23 of the instrument. The mounting screw 17 may be configured of the same metal or material as the positional constant string pitch control system 30 to prevent galvanic corrosion from occurring.

Although illustrated as a single mounting screw 17 that attaches the positional constant string pitch control system 30 to the instrument, other configurations are possible and the arrangement shown should be considered non-limiting. In an alternate configuration, the positional constant string pitch control system 30 may be attached through a chemical bond to the neck 24 or body 23 of the instrument. In another non-limiting embodiment, the positional constant string pitch control system 30 may be attached to the neck 24 or body 23 of the instrument by a series of locking slides placed in the neck or body of the instrument. In this embodiment, the positional constant string pitch control system 30 may be slid onto the neck 24 or body 23 of the instrument and placed into proper position by a series of locks that prevent further movement of the positional constant string pitch control system 30 when placed into correct position.

Figure 7:
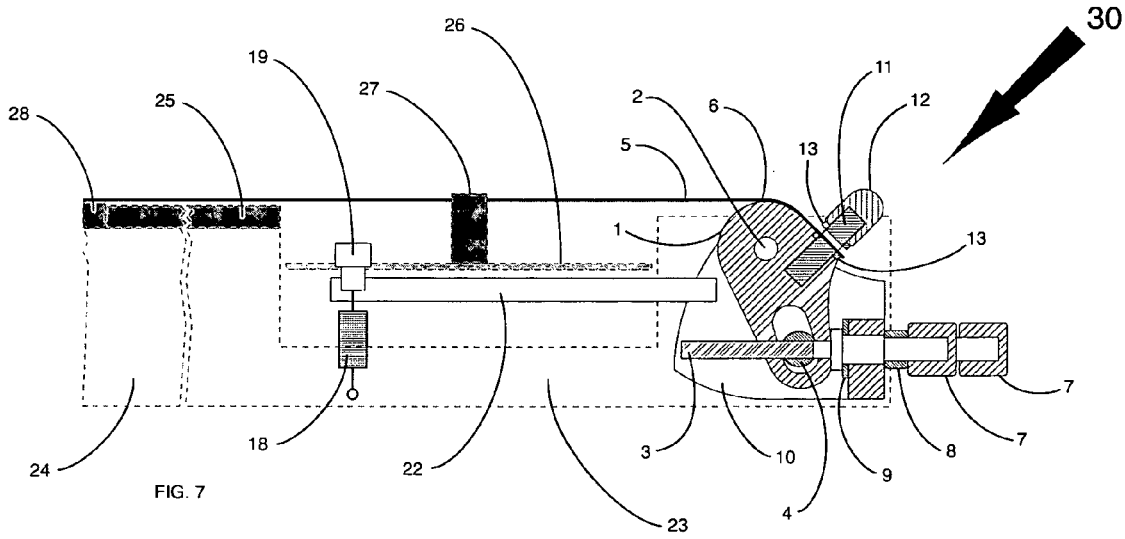
FIG. 7 is a contracted sectional side view of the positional constant string pitch control system in conformance with an embodiment of the invention.

In the illustrated embodiment provided in FIG. 7, the positional constant string pitch control system 30 is mounted to the body 23 of the instrument, depicted with the pivot structure 10 and without the mounting structure 15. The positional constant string pitch control system 14 is a modular assembly configurable for single string 5 or multiple string 5 arrangements, which can include the mounting structure 15 as combined in a positional constant string pitch control system 30 as illustrated in FIG. 6, the mounting of said modular assembly adjustably or fixably rotatably positionable, relative to the plane of the string 5, with the objectives of, including: facilitating controlled positional constant surface rotation, facilitating intonation adjustments, facilitating string 5 spacing adjustments, facilitating longitudinal, tangential or lateral adjustments relative to an appropriate intonation harmonic, facilitating string action adjustments relative to the neck 24 or body 23, facilitating adjustments relative to the bridge 27, facilitating orientation of string pitch control surfaces 7, as non-limiting examples.

The positional constant string pitch control system 14 or 30 can be mounted to the neck 24 or body 23 of the instrument, independent of the soundboard 26 as illustrated in an installed embodiment FIG. 7, thus disassociating—in comparison to conventional technologies—longitudinal, tangential, and lateral string tension forces from the soundboard, e.g., neutral tension. In an arrangement as illustrated in FIG. 7, the positional constant string pitch control system 14 or 30 can be employed in combination with a bridge 27. The positional constant string pitch control system 14 or 30 can be mounted to the soundboard 26 or independent of the soundboard 26 for employment as an intonation point.

Figure 8:
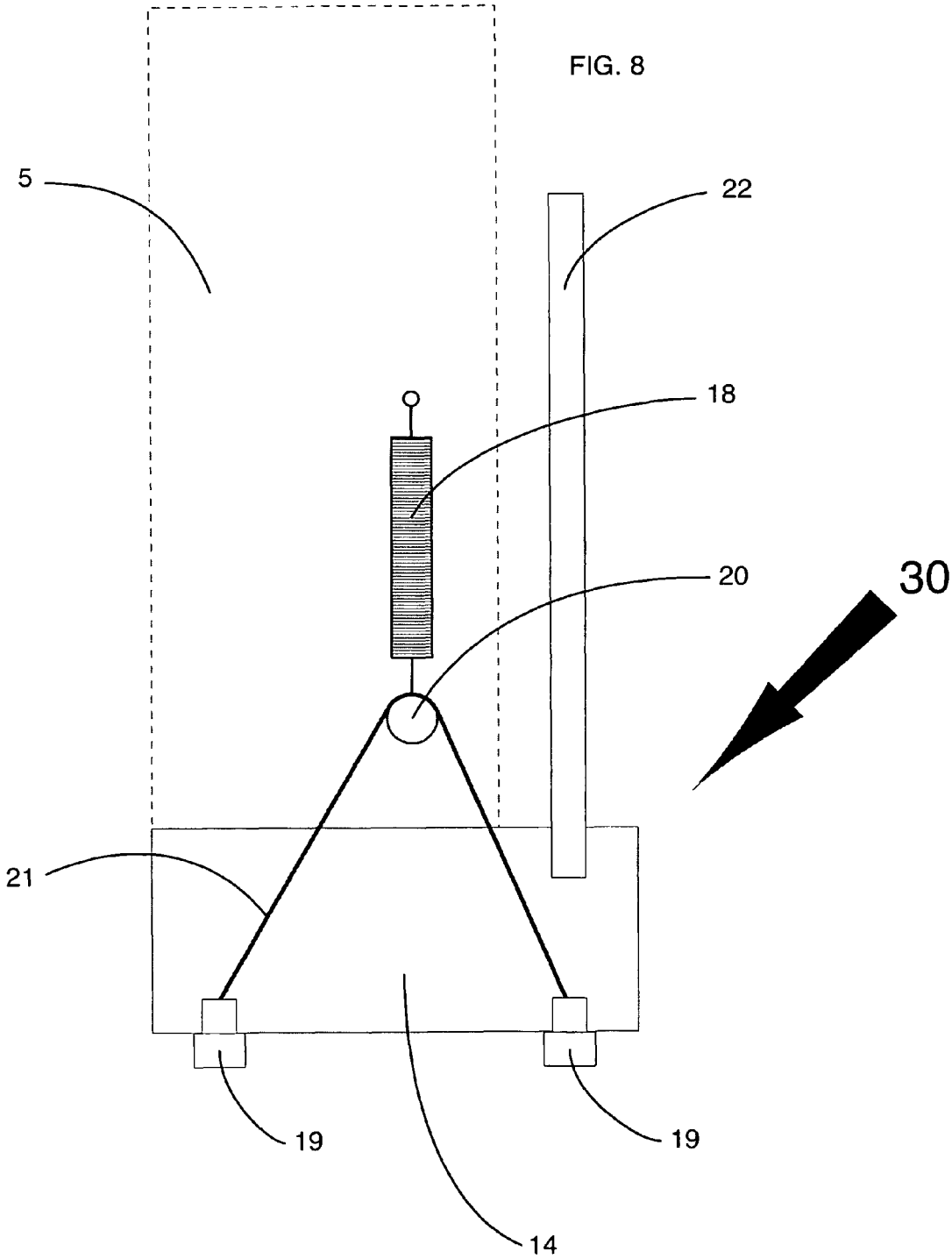
FIG. 8 is a sectional bottom view of the positional constant string pitch control system in conformance with an embodiment of the invention.

An adjustably tensioned spring 18 or arrangement of springs 18 can be combined with the pivot structure 10 or the bearing 8 or the mounting structure 15 to counteract longitudinal string 5 tension force on the rotatable surface 1 or the positional string pitch control system 14 or 30, as illustrated in FIGS. 6, 7, and 8. The spring 8 or arrangement of springs can be self-contained within the positional constant string pitch control system 30 as illustrated in FIG. 6, or configured between the instrument and tremolo input device 22 as illustrated in FIG. 19, or configured between the positional constant string pitch control system 14 or 30 and the instrument as illustrated in FIG. 8. The tremolo input device 22 can be positioned above, even with, or below—as illustrated in FIG. 7—relative to the plane of the string 5. The relationship between the spring 8 or springs, and the positional constant string pitch control system 14 or 30, and the instrument, can employ a combination of relationship configurations for the purposes of counteracting longitudinal string 5 tension force and reducing harmonic oscillation and decreasing pitch equilibrium return times when the positional constant string pitch control system 14 or 30 is used for tremolo or vibrato, examples of which can include: one of said arrangements, at least one of said arrangements, all of said arrangements.

The arrangement of spring 18 or springs 18 can be configured to create a non-linear spring actuation force potential regarding equilibrium between spring 18 forces and string 5 tension forces, e.g., exponential spring actuation force, which requires increasingly greater force to progress, thus causing increasingly greater incentive to seek equilibrium, reducing harmonic oscillation and facilitating rapid return to pitch neutral. The arrangement of spring 18 or springs 18 can include, as non-limiting examples: at least two equal force springs 18 or unequal force springs 18 asymmetrically mounted relative to the pivot point 2, at least one of a spring 18 that is not actuated at pitch neutral and that is employed to supplement spring tension forces upon disruption of equilibrium, etc.

Referring to FIG. 6, the spring 18 or arrangement of springs 18, can be configured anchored between the pivot structure 10 or the bearing 9 and the mounting structure 15, employing an extension or compression spring 8 arrangement adjustable by means of the spring tension adjustor 19 which securely holds one end of the spring 18 yet facilitates precisely controllable spring 18 tension adjustments, for the purposes of adjustably counteracting string 5 tension force in a maintained state of equilibrium. Referring to FIG. 7, an alternate embodiment of the invention is illustrated with the spring tension adjustor 19 mounted to the tremolo input device 22, an arrangement of which can be reversed, with the spring tension adjustor 19 mounted to the body, or to both locations, as desired, in order to precisely control spring tension adjustments.

Use of at least one spring tension adjustor 19 is employed in the spring force distributing arrangement illustrated in an alternate embodiment, FIG. 8. A spring load pulley 20 equalizes forces on the force distributor 21 to reduce structural distortion potential within the positional constant string pitch control system 14 or 30, as the tremolo input device 22 is actuated. The arrangement of spring load pulley 20 and force distributor 21 can be self-contained within the positional constant string pitch control system 30, or configured between the instrument and tremolo input device 22, or configured between the positional constant string pitch control system 14 or 30 and the instrument as illustrated in FIG. 8. The relationship between the arrangement of spring load pulley 20 and force distributor 21 assembly, and the positional constant string pitch control system 14 or 30, and the instrument, can employ a combination of relationship configurations for the purposes of counteracting longitudinal string 5 tension force, reducing structural distortion potential, and reducing harmonic oscillation and decreasing pitch equilibrium return times when the positional constant string pitch control system 14 or 30 is used for tremolo or vibrato, examples of which can include: one of said arrangements, at least one of said arrangements, all of said arrangements.

In the illustrated embodiments provided, the spring tension adjustor 19 and the spring load pulley 20 and the force distributor are made of a material that is rugged to allow the positional constant string pitch control system 14 or 30 to be capable of counteracting string and spring tension on a string of a stringed instrument without significant bending, warping, or need for servicing. Such materials may be, as non-limiting examples, aluminum, steel, brass, copper, metallic alloys, sturdy plastics and epoxy materials, or wood. In the illustrated embodiment FIG. 8, the spring tension adjustor 19 is made of stainless steel or bronze for strength and non-corrosive properties. The spring load pulley 20 of bronze for smooth rotation. The force distributor 21 is made of stainless steel flexible wire rope for supple movement and longevity.

What is claimed:

1. An positional constant string pitch control system, comprising:

a rotatable surface configured to contact a string;

a pivot configured to interface with the rotatable surface and allow rotation of the rotatable surface around the pivot;

a nut with at least one opening, the nut configured to interact with the rotatable surface;

a string pitch adjustment shaft configured to interface with the rotatable surface through the nut with the at least one opening and move the surface and the nut upon actuation of the shaft;

a string pitch adjustment control surface configured to interact with the string and control a pitch of the string;

a bearing configured to contact the string pitch adjustment shaft; and a pivot structure configured to interface with the rotatable surface and the pivot to allow the rotatable surface to rotate.

2. The positional constant string pitch control system according to claim 1, wherein the bearing is configured to contact the string pitch adjustment shaft such that a string tension force on the string pitch adjust shaft is resisted.

3. The positional constant string pitch control system according to claim 1, wherein the string pitch adjustment control surface is a knob.

4. The positional constant string pitch control system according to claim 3, wherein the knob is configured to tune the string.

5. The positional constant string pitch control system according to claim 1, wherein the pivot is configured to allow the rotatable surface to rotate on a user defined axis.

6. The positional constant string pitch control system according to claim 1, wherein the pivot structure is configured to interface with the rotatable surface to allow the rotatable surface to rotate around the pivot.

7. The positional constant string pitch control system according to claim 1, further comprising:

a mounting structure configured to interact with a surface of a stringed instrument.

8. The positional constant string pitch control system according to claim 1, further comprising:

at least one of a string anchor post and string anchor nut to engage and anchor a string of a stringed instrument.

9. The positional constant string pitch control system according to claim 4, wherein the knob is an interlocking knob.

10. The positional constant string pitch control system according to claim 1, wherein a receiving end of the string pitch adjustment shaft is configured to engage the string pitch control surface.

11. The positional constant string pitch control system according to claim 7, wherein the mounting structure is configured to attached to the surface of the stringed instrument through at least one of a chemical fastener and a mechanical fastener.

12. The positional constant string pitch control system according to claim 11, wherein the mechanical fastener is a screw.

13. The positional constant string pitch control system according to claim 7, wherein the mounting structure is connected to at least one of a neck and a body of the stringed instrument.

14. The positional constant string pitch control system according to claim 1, further comprising:

an adjustable pitch lock configured to interface with the string pitch control surface, wherein the string pitch control surface is secured into position through the adjustable pitch lock.

15. The positional constant string pitch control system according to claim 1, wherein the string pitch adjustment shaft is threaded.

16. An positional constant string pitch control system, comprising:

a rotatable surface configured to contact a string;

a pivot configured to interface with the rotatable surface and allow rotation of the rotatable surface around the pivot;

a string pitch adjustment shaft configured to interface with the rotatable surface and move the surface upon actuation of the shaft;

a string pitch adjustment control surface configured to interact with the string and control a pitch of the string;

a bearing configured to contact the string pitch adjustment shaft; and a pivot structure configured to interface with the rotatable surface and the pivot to allow the rotatable surface to rotate.

17. A method to hold a string of a stringed instrument, comprising:

providing at least one string of a stringed instrument;

securing a first end of the string to the instrument;

routing the at least one string over at least one positional constant rotatable surface;

securing a second end of the string to the instrument; and actuating the at least one positional constant rotatable surface so that the surface moves against the at least one string, wherein the actuating of the string over the at least one positional constant rotatable surface causes a tension in the at least one string.

* * * * *